US011897657B2

(12) United States Patent
Brinkers et al.

(10) Patent No.: US 11,897,657 B2
(45) Date of Patent: Feb. 13, 2024

(54) CONTAINER HAVING A SUPPORT PLATE WHICH HAS PROJECTIONS

(71) Applicant: Schoeller Allibert GmbH, Schwerin (DE)

(72) Inventors: Erik Brinkers, Emmen (NL); John Andrew Dyer, Staffordshire (GB); John Huizingh, Vlagtwedde (NL)

(73) Assignee: Schoeller Allibert GmbH, Schwerin (DE)

( * ) Notice: Subject to any disclaimer, the term of this patent is extended or adjusted under 35 U.S.C. 154(b) by 158 days.

(21) Appl. No.: 17/608,657

(22) PCT Filed: Apr. 6, 2020

(86) PCT No.: PCT/EP2020/059749
§ 371 (c)(1),
(2) Date: Nov. 3, 2021

(87) PCT Pub. No.: WO2020/224895
PCT Pub. Date: Nov. 12, 2020

(65) Prior Publication Data

US 2022/0204208 A1 Jun. 30, 2022

(30) Foreign Application Priority Data

May 7, 2019 (EP) ..... 19173132

(51) Int. Cl.
*B65D 1/22* (2006.01)
*B65D 21/02* (2006.01)

(52) U.S. Cl.
CPC ..... *B65D 1/22* (2013.01); *B65D 21/0212* (2013.01)

(58) Field of Classification Search
CPC ..... B65D 1/22; B65D 21/0212; B65D 25/24; B65D 21/0216; B65D 21/066; B65D 21/0223
(Continued)

(56) References Cited

U.S. PATENT DOCUMENTS 2,409,748 A * 10/1946 Folst ..... B65D 85/305 206/512
4,190,172 A * 2/1980 Box ..... B65D 85/305 220/510
(Continued)

FOREIGN PATENT DOCUMENTS

DE 4006188 C1 7/1991
DE 19844015 A1 3/2000
(Continued)

OTHER PUBLICATIONS

Search Report received in International Search Report received in Application No. PCT/EP2020/059749 dated May 12, 2020, with translation, 5 pages.
(Continued)

*Primary Examiner* — Ernesto A Grano
(74) *Attorney, Agent, or Firm* — Christopher A. Rothe; Culhane Meadows PLLC

(57) ABSTRACT

A container includes a base; side walls extending upwards from an upper face of the base; and at least one support plate which is spaced apart from a lower face of the base and is connected to the lower face of the base by ribs extending transversely to the base and transversely to the at least one support plate. At least two laterally protruding projections are formed at least on an edge portion of the support plate extending along one of the side walls. At least two support recesses for receiving at least two projections of a support
(Continued)

plate of an identical container stacked thereon are formed in the upper edge portion of the at least one side wall.

16 Claims, 4 Drawing Sheets

(58) Field of Classification Search
USPC ..... 206/509
See application file for complete search history.

(56) References Cited

U.S. PATENT DOCUMENTS 4,256,224 A * 3/1981 Hirota ..... B65D 71/0003 206/427
5,392,915 A * 2/1995 Kalin ..... B65D 25/06 206/508
5,397,022 A * 3/1995 Schafer ..... B65D 1/40 220/675
5,551,594 A * 9/1996 Schafer ..... B65D 1/40 220/675
5,735,431 A * 4/1998 LeTrudet ..... B65D 19/0026 220/639
6,220,385 B1 4/2001 Bohner et al.
6,467,646 B2 * 10/2002 Schafer ..... B65D 1/42 220/636
7,784,615 B2 * 8/2010 Stahl ..... B65D 21/045 206/511
8,651,309 B2 * 2/2014 Gualersi ..... B65D 11/1833 220/613
2002/0030057 A1 * 3/2002 Schafer ..... B65D 1/22 220/600
2002/0195454 A1 * 12/2002 Schafer ..... B65D 1/40 220/628
2008/0296194 A1 * 12/2008 Stahl ..... B65D 21/045 206/518
2009/0151226 A1 * 6/2009 Apps ..... B65D 21/0212 43/100
2011/0240637 A1 * 10/2011 Orgeldinger ..... B65D 85/34 220/601
2012/0241349 A1 * 9/2012 Koefelda ..... B65D 1/34 206/507
2014/0251992 A1 * 9/2014 Cavalcante ..... B65D 11/184 220/4.28
2017/0001756 A1 * 1/2017 Plattner ..... B65D 21/0213
2018/0162583 A1 * 6/2018 Pick ..... B65D 1/42
2018/0251260 A1 * 9/2018 Hassell ..... B65D 21/046
2022/0081167 A1 * 3/2022 Huizingh ..... B65D 25/54

FOREIGN PATENT DOCUMENTS

DE 102008020916 A1 12/2009
DE 102013207943 A1 10/2014

OTHER PUBLICATIONS

Extended European Search Report received in European Application No. 19173132.2-1017 dated Oct. 25, 2019, with translation, 11 pages.
Written Opinion received in International Application No. PCT/EP2020/059749 dated May 12, 2020, with translation, 9 pages.

* cited by examiner

CONTAINER HAVING A SUPPORT PLATE WHICH HAS PROJECTIONS

CROSS-REFERENCES TO RELATED APPLICATIONS

This application is the United States national phase entry of International Application No. PCT/EP2020/059749, filed Apr. 6, 2020, and claims the benefit of priority of European Application No. 19173132.2, filed May 7, 2019. The contents of International Application No. PCT/EP2020/059749 and European Application No. 19173132.2 are incorporated by reference herein in their entireties.

FIELD

The present invention relates to a container, in particular to a container for transporting goods on roller conveyors having a bottom, side walls and a support plate connected via ribs to a lower side of the bottom.

BACKGROUND

Conventional containers are known, for example, from DE 10 2008 020 916 A1 or DE 10 2013 207 943 B4. These containers each have a bottom with a rectangular outline, side walls extending vertically upwards from the bottom, and a support plate, which is connected to a lower side of the bottom via ribs.

The problem with these containers is that they generate relatively loud noises during transport on roller conveyors due to contact between the stable composite of the bottom and the support plate with rollers of the roller conveyor.

It is therefore an object of the present invention to provide a container which allows a quieter transport on roller conveyors.

SUMMARY

A container according to the invention has a bottom, side walls, and at least one support plate connected via ribs to a lower side of the bottom.

The side walls extend transversely, in particular perpendicularly, upwards from an upper side of the bottom.

The support plate is spaced from the lower side of the bottom and extends in particular parallel to the lower side of the bottom.

The ribs connecting the at least one support plate to the lower side of the bottom extend transversely, in particular perpendicularly, to the bottom or to the lower side of the bottom and transversely, in particular perpendicularly, to the support plate.

The container according to the invention is configured such that at least two projections project laterally from at least one edge portion of the support plate extending along one of the side walls. In particular, the projections each have the shape of a plate. In particular, the projections are configured in such a way that they each have free ends on three sides and are connected to the support plate by a fourth side.

In other words, the container according to the invention is characterized in that at least two projections are formed on the at least one support plate in such a way that the support plate together with the at least two projections form, at least in sections, an outline with a crenellated outer contour.

In particular, the plate-shaped projections each have a rectangular or substantially rectangular or trapezoidal or substantially trapezoidal outline. In particular, one edge of each plate-shaped projection having a rectangular outline is connected to the at least one support plate. In particular, three of the four edges of each plate-shaped projection with rectangular or trapezoidal outline are free or at least free in sections.

By providing the projections, the deformability of the support plate can be increased locally. In addition, when the container is transported on a roller conveyor, direct impact of the support plate on rollers can be made more difficult or prevented.

In the upper edge portion of the at least one side wall, at least two support indentations are provided for receiving at least two projections of a support plate of an identically constructed container stacked thereon.

In other words, at least the side wall along which the at least one edge portion of the at least one support plate provided with at least two projections in each case extends has at least two respective support indentations, in an edge portion facing away from the bottom, in particular in an upper edge portion on an upper side, wherein the support indentations are configured in such a way that they each receive a projection of a support plate of an identically constructed container in a state in which the identically constructed container is stacked on the container.

The projections increase the outer dimensions of the support plate so that more rollers can be touched simultaneously by the container during transport on a roller conveyor compared to a container with a support plate without lateral projections. Thus, a more stable and thus quieter transport behavior can be achieved. By providing support indentations, the excess length by which the projections project laterally can be increased in an advantageous manner without impairing the stacking properties of the container.

At least one of the at least two projections can be connected to the lower side of the bottom via at least one rib extending transversely to the bottom and transversely to the at least one support plate. In particular, the rib connecting the projection and the lower side of the bottom can extend perpendicularly to the bottom or to the lower side of the bottom and/or perpendicularly to the support plate.

By providing the rib connecting the projection and the lower side of the bottom, the local increase in deformability caused by the free ends of the projections can be limited.

The at least one rib connecting the bottom to one of the at least two projections may have a wall thickness that is less than an average wall thickness of the container. Additionally or alternatively, the at least two projections may have a wall thickness that is less than the average wall thickness of the container. The wall thickness of the at least one rib connecting the bottom to one of the at least two projections and the wall thickness of the at least two projections may be equal. Alternatively, the wall thickness of the at least one rib connecting the bottom to one of the at least two projections may be less than the wall thickness of the at least two projections. In this context, 'wall thickness' is understood to mean the thickness of plate-shaped components, for example the plate-shaped rib or the plate-shaped projections. In particular, the wall thickness of the rib connecting the bottom to one of the at least two projections and/or of the projections may be less than a wall thickness of the bottom or a wall thickness of the side walls.

By locally reducing the wall thickness, the flexibility of the container can be increased locally in an advantageous manner, so that an impact on rollers can be dampened when the container is transported on a roller conveyor. Such improved impact behavior can alternatively or additionally also be achieved by a local reduction in the density of the ribs connecting the bottom to the projections. In this context, the term 'density of the ribs' refers to the number of ribs per predetermined uniform area of the plate-shaped projections.

On an edge portion of the at least one support plate, which is opposite the edge portion of the at least one support plate provided with the at least two projections, at least two laterally projecting projections can also be formed, in particular in the form of a plate in each case. In other words, at least four similar projections according to the invention can be provided on the at least one support plate. Those of the side walls along which the edge portions of the at least one support plate extend, each provided with at least two projections, can each have at least two support indentations in an edge portion facing away from the bottom, i.e. in particular in an upper edge portion on an upper side. The support indentations can be designed in such a way that they each receive a projection on a support plate of an identically constructed container in a state in which the identically constructed container is stacked on the container.

If projections are provided on two opposite sides of the at least one support plate, a noise-reducing effect can be achieved not only when the container is moved in a single particular orientation on a roller conveyor.

On the side walls provided with at least two support indentations in each case, at least one handle can be formed in the edge portion facing away from the bottom, i.e. in particular the upper edge portion, on an outer side of the respective side wall between the corresponding at least two support indentations.

A bulge extending outwards can be formed on each of the side walls provided with at least two support indentations in the area of each support indentation on the outer side of the corresponding side wall. The at least two handles can each be formed as a rib extending between the at least two bulges of a corresponding side wall transversely, in particular perpendicularly, to the corresponding side wall.

Lower sides of the at least four projections of the at least one support plate may extend in a common plane. Lower surfaces of the at least four support indentations may extend in a common plane. A distance between the common plane of the lower sides of the at least four projections of the at least one support plate and the lower side of the bottom may be less than or equal to a distance between the common plane of the lower surfaces of the at least four support indentations and an upper border of the container. This configuration of the support indentations or projections can advantageously ensure that the container does not rest on the projections when it is stacked on an identically constructed container.

At edge portions of the bottom, which extend along edge portions of the at least one support plate provided with at least two projections in each case, at least one respective column can be formed which extends transversely, in particular perpendicularly, downwards to the bottom or to the lower side of the bottom, and wherein said column projects downwards from the container by less than the at least one support plate and projects outwards or laterally from the container by less than the respective at least four projections on the at least one support plate. In particular, the columns may be formed at corners of the bottom. The edge portions of the side walls facing away from the bottom, in particular the upper edge portions, which are each provided with at least two support indentations, and the corresponding support indentations can be coordinated with the projections on the support plate and the columns in such a way that, in a state in which the container is stacked on an identically constructed container, a lateral displacement of the container in relation to the identically constructed container is limited and/or prevented by cooperation of the columns with an inner side of side walls of the identically constructed container, and the projections of the at least one support plate of the container do not touch inner surfaces of corresponding support indentations of the identically constructed container. This adjustment allows the projections to be protected from stress when several identically constructed containers are stacked on top of each other. In the vertical direction, a force introduced by an identically constructed container stacked on top of a container can be dissipated via the upper border of the container, and in the lateral direction or in lateral directions, the columns of the container can dissipate lateral forces introduced by the identically constructed container.

The ribs connecting the at least one support plate to the lower side of the container may have apertures. Due to the apertures, the ribs can be easily formed.

The apertures may be arranged non-mirror-symmetrically to each other. The non-mirror-symmetrical arrangement of the apertures can make it more difficult for acoustic waves and/or vibrations to propagate.

The apertures of the ribs can be arranged rotationally symmetrical to each other with respect to a central axis of the container extending perpendicular to the bottom. In particular, the apertures can be designed and arranged in such a way that they are mapped onto themselves when rotated by 180° about the central axis. A rotationally symmetrical arrangement can simplify the design of the container or of tools.

The projections may be covered with a material or may be made of a material that is softer than a material or materials of the other parts of the container. Thus, advantageously, the material of the projections can be optimized for damping an impact on rollers of a roller conveyor without compromising the structural integrity of the remaining container parts.

The bottom, the side walls, the at least one support plate and the ribs connecting the bottom and the at least one support plate can be formed in one piece. A one-piece design can save time-consuming assembly steps.

The container may be made of plastic. Plastic is advantageously suitable for applications with high hygiene requirements, for example for foodstuffs.

The at least one support plate may have at least one aperture. In particular, the at least one support plate may have a central aperture such that the support plate is substantially in the shape of a ring. In particular, the annular support plate extends along the edges of the bottom. In this way, the container can be manufactured in lightweight construction and can still be placed in a stable manner on a flat support.

The bottom may have a substantially rectangular outline. The side walls may have two opposite, long side walls arranged at long edges of the bottom and two opposite short side walls arranged at short edges of the bottom. The container may be formed such that projections are formed only on edge portions of the at least one support plate extending along the long side walls. When a container with a rectangular outline is transported on a roller conveyor, noise is generated in particular when the container is transported with one of its long side walls running in front. If projections are only provided on the long side walls of the support plate, a noise-reducing effect can be achieved with relatively few adjustments.

BRIEF DESCRIPTION OF THE DRAWING FIGURES

The present invention is described in more detail below with reference to the accompanying drawings by way of preferred configuration examples, in which.

DETAILED DESCRIPTION

Figure 1:
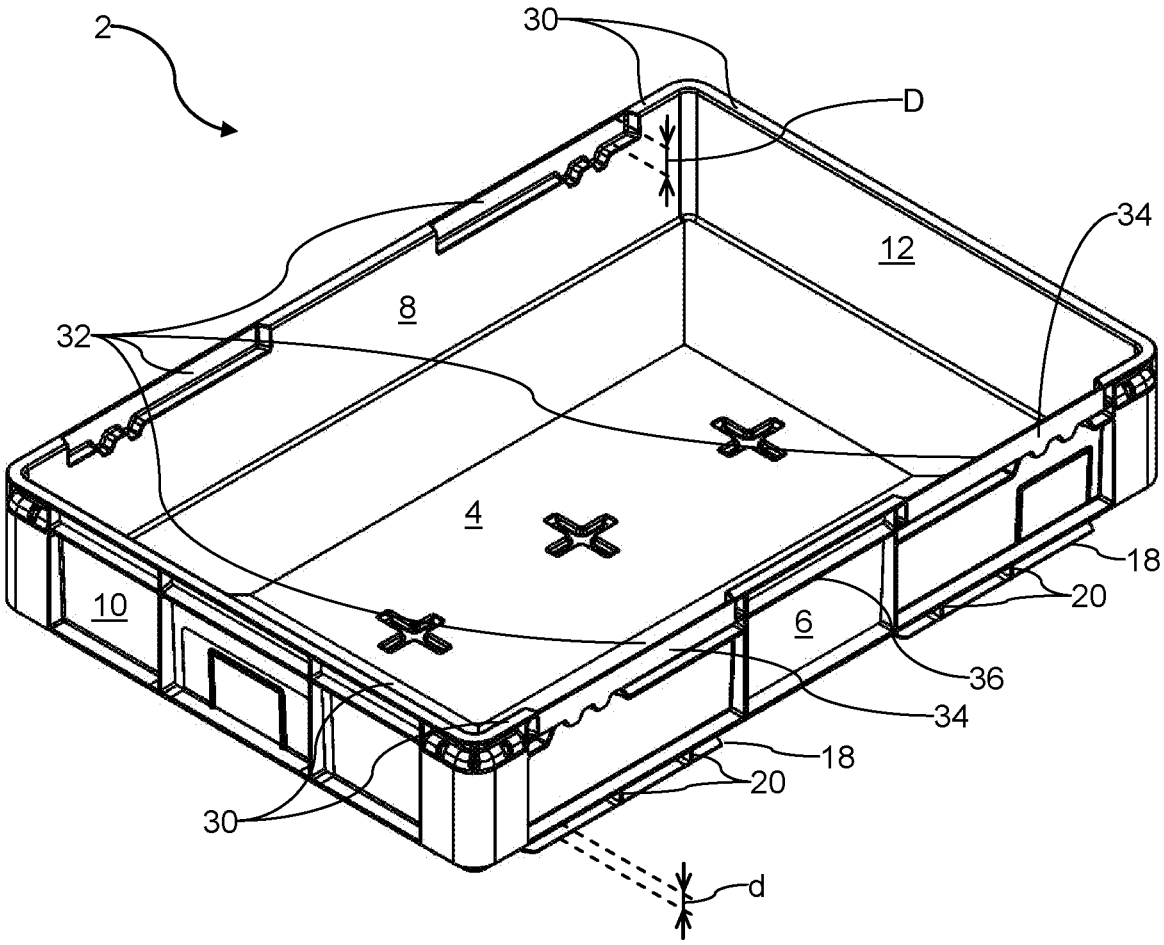
FIG. 1 shows a perspective view of a container from an oblique top view.
Figure 2:
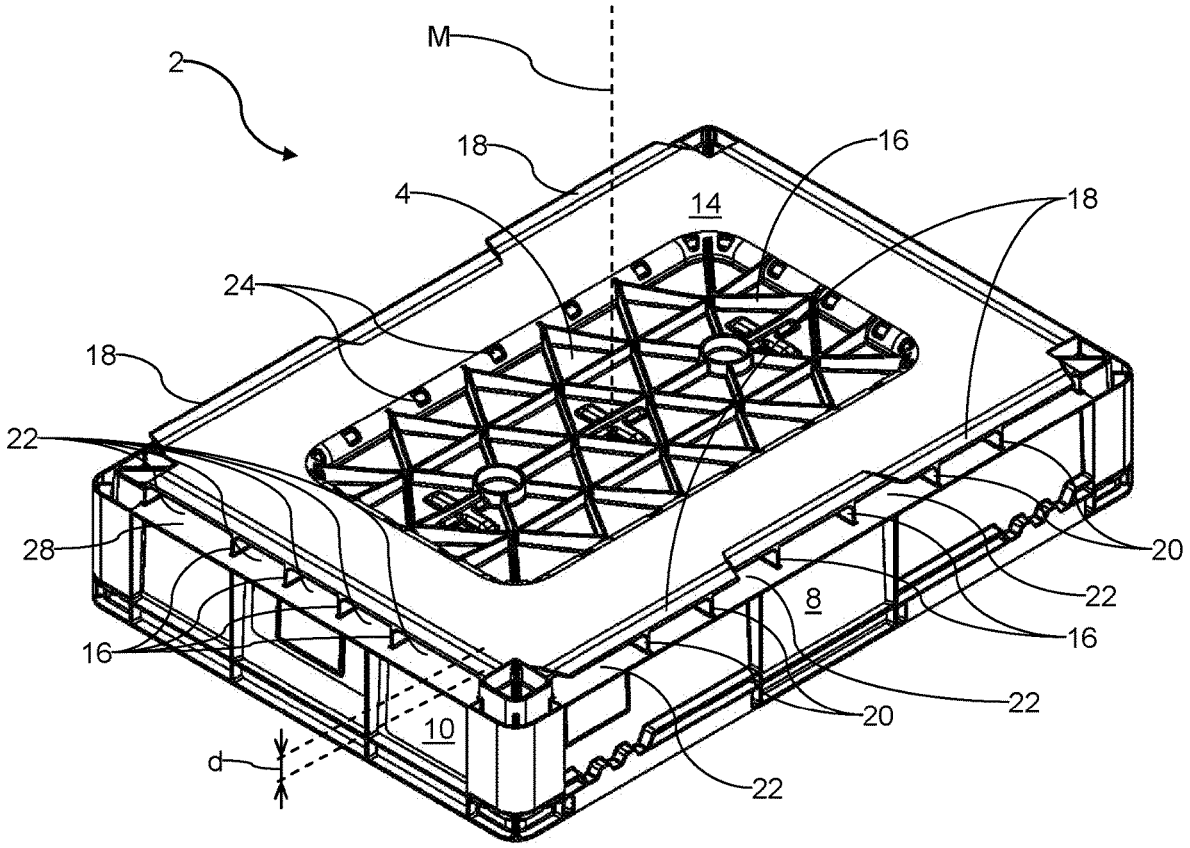
FIG. 2 shows a perspective view of the container shown in FIG. 1 from an oblique bottom view.

FIG. 1 shows a container 2 according to the invention in a perspective view from an oblique top view. FIG. 2 shows the container 2 according to the invention in a perspective view from an oblique bottom.

As shown in FIG. 1 and FIG. 2, the container 2 has a bottom 4 with a substantially rectangular outline from whose long edges, two opposite long side walls 6 and 8 extend upwards and from whose short edges, two opposite short side walls 10 and 12 extend upwards. Each side wall 6, 8, 10 and 12 has a substantially rectangular outline.

Below the bottom 4, a support plate 14 extending at least substantially parallel to the bottom 4 is provided, which is connected to a lower side of the bottom 4 via ribs 16.

The support plate 14 has the outline of a substantially rectangular ring and is dimensioned such that outer edges of the support plate 14 extend parallel to the edges of the bottom 4.

The ribs 16 extend perpendicularly to the bottom 4 or perpendicularly to the support plate 14. Furthermore, the ribs 16 extend not only between the support plate 14 and the bottom 4 but also reinforce the bottom 4 in an area within the annular support plate 14.

Projections 18 are formed on the outer edges of the support plate 14, which extend along the long side walls 6 and 8. Each of the two corresponding outer edges has two respective projections 18. Each of the projections 18 has the shape of a plate with a trapezoidal outline. The projections 18 are each connected by their long base or base side to the support plate 14 in such a way that they each extend the support plate locally. This means that the support plate 14 and the projections 18 lie in a common plane. Furthermore, the projections 18 have a chamfer on a lower side at their short base.

The projections 18 are each connected to the lower side of the bottom 4 via two ribs 20. The ribs 20 run perpendicularly to the lower side of the bottom 4 and perpendicularly to the respective projection 18.

The outer edges of the support plate 14, which extend along the short side walls 10 and 12, each have a chamfer on the lower side of the container 2. The chamfer on the outer edges of the support plate 14 along the short side walls 10 and 12 corresponds in its shape to the chamfer on the short bases of the plate-shaped projections 18. The ribs 16 and the ribs 18 are designed in such a way that several ribs are lined up parallel to each other along the outer edges of the bottom 4 in such a way that they form pockets 22 open to the outside between them and together with the lower side of the bottom 4 and an upper side of the support plate 14 or an upper side of the projections 18.

Figure 3:
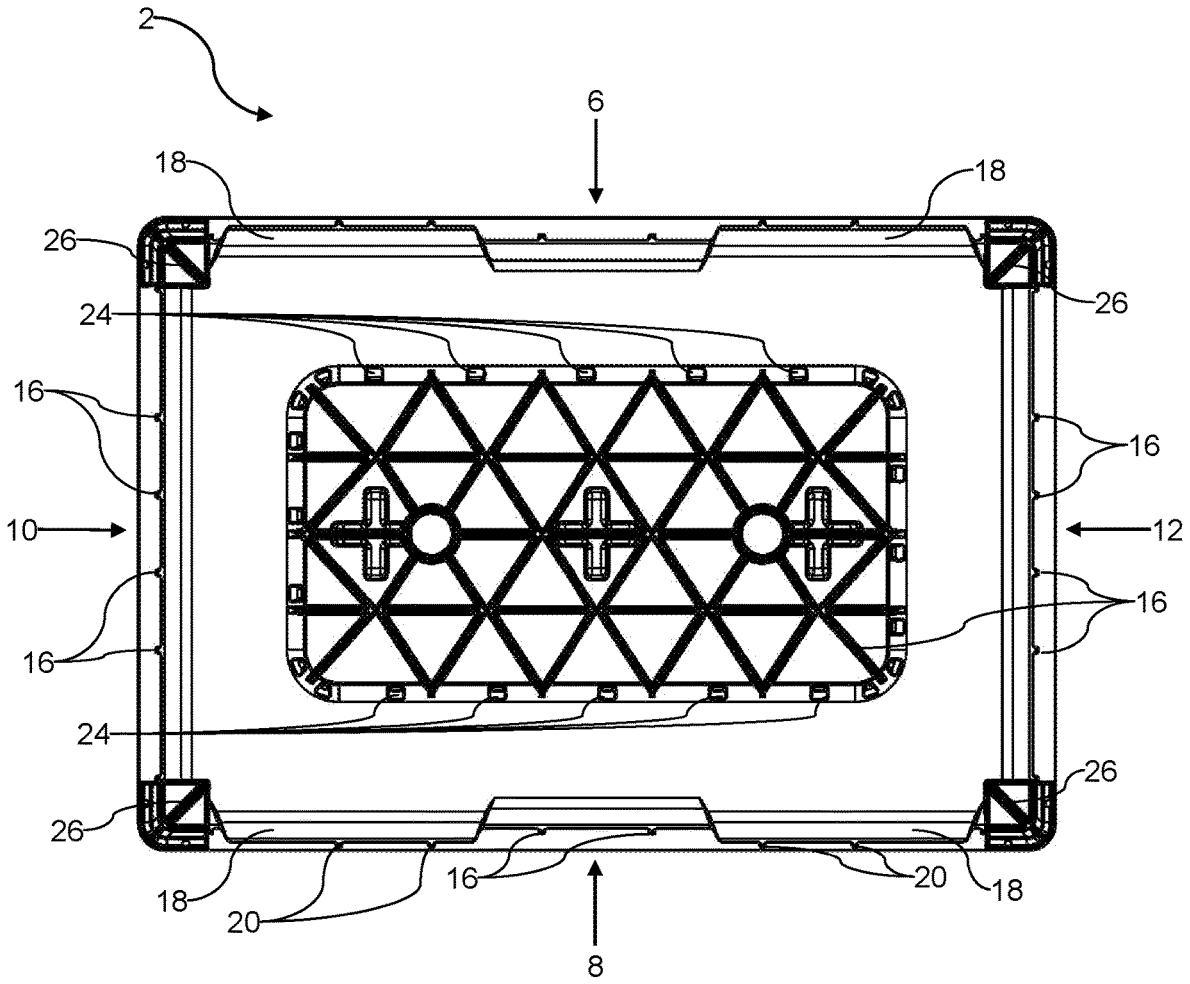
FIG. 3 shows a bottom view of the container shown in FIG. 1.

The ribs 12 are also formed in such a way that one of the ribs 12 connects an inner edge of the annular support plate 14 to the lower side of the bottom 4. The pockets 22 are bounded inwards by this circumferential rib. As also shown in FIG. 3, apertures 24 are provided in the circumferential rib, which are arranged rotationally symmetrically with respect to a central axis M running perpendicularly to the bottom 4. Within the inner edge of the annular support plate 14, the ribs 12 are arranged in the manner of trusses.

A respective column 26, hereinafter referred to as corner column 26, is formed at the corners of the bottom 4. The four corner columns 26 each connect a long side wall 6 or 8 with a short side wall 10 or 12.

As shown in FIG. 3, the outer edges of the support plate 14 and the short bases of the projections 18 are offset inwards with respect to the side walls 6, 8, 10 and 12. When the container 2 is stacked on an identically constructed container, an outer edge portion 28 of the bottom 4 rests on an upper edge portion 30 of the side walls 6, 8, 10 and 12. To ensure that the projections 18 do not prevent such resting, two support indentations 32 are formed on the upper edge portion 30 of the side walls 6, 8, 10 and 12 for each side wall. The support indentations 32 are each formed in such a way that a distance D from an upper edge of the container 2 to a lower surface of the respective support indentation is greater than a distance d between the lower sides of the projections 18 and the lower side of the bottom 4. When the container 2 is stacked on the identically constructed container, the projections 18 are received in the support indentations 32. The projections 18 do not touch the inner side surfaces of the support indentations 32. This is ensured by the fact that a clearance between outer surfaces of the corner columns 26 and an inner surface of the side walls of the identically constructed container is smaller than a clearance between the short bases of the projections 18 and a respective outer inner surface of a corresponding support indentation of the identically constructed container.

The support indentations 32 are implemented by bulges of the long side walls 6 and 8. This means that the long side walls 6 and 8 each have a bulge 34 on their respective outer side in the area of a respective support indentation 32. Between the two bulges 34 of a respective long side wall 6 or 8, a rib running perpendicularly to the corresponding long side wall 6 or 8 is provided, which forms a handle 36.

Figure 4:
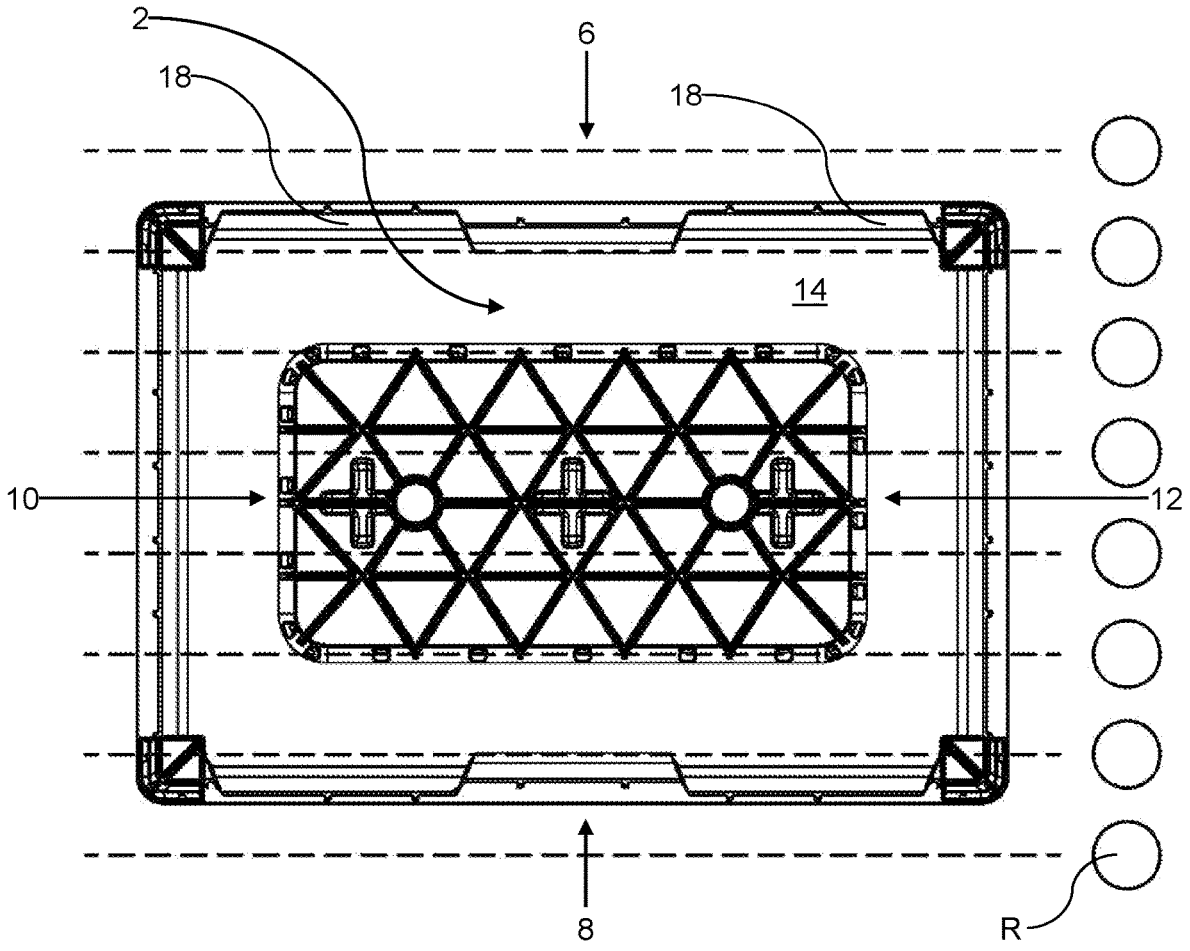
FIG. 4 shows the bottom view shown in FIG. 3 with schematically indicated rollers of a roller conveyor.

FIG. 4 shows a bottom view of the container 2 together with schematically illustrated rollers R of a roller conveyor. If a container 2 is transported on the roller conveyor with the long side wall 6 running in front, the short bases of the projections 18 first hit a corresponding roller before the remaining parts roll, slide or move rollingly over the same roller. Since not only the short bases of the projections 18 but also the legs of the projections 18 are free ends at least in sections, the projections 18 are easily deformable and dampen the impact of the container 2 on the corresponding roller R.

The invention claimed is:

1. A container, comprising:

a bottom;

side walls extending upwards from an upper side of the bottom; and at least one support plate spaced from a lower side of the bottom, which is connected to the lower side of the bottom via ribs extending transversely to the bottom and transversely to the at least one support plate, wherein:

at least two projections project laterally from at least one edge portion of the at least one support plate extending along at least one side wall of the side walls, at least two support indentations are formed in an upper edge portion of the at least one side wall for receiving at least two projections of a support plate of an identically constructed container stacked thereon, and at least one of the at least two projections is connected to the lower side of the bottom via at least one rib extending transversely to said bottom and transversely to said at least one support plate.

2. The container according to claim 1, wherein the at least one rib connecting the bottom to one of the at least two projections and/or the at least two projections have a respective wall thickness which is less than an average wall thickness of the container.

3. The container according to claim 1, wherein:

at least two laterally projecting projections are also formed on a second edge portion of the at least one support plate, wherein the second edge portion is opposite the at least one edge portion of the at least one support plate, and a side wall that is opposite the at least one side wall also comprises at least two support indentations in the upper edge portion for receiving at least two laterally projecting projections of a support plate of an identically constructed container stacked thereon.

4. The container according to claim 3, wherein at least one handle is formed on the side walls provided with at least two support indentations in each case in the edge portion facing away from the bottom on an outer side of the respective side wall between the corresponding at least two support indentations.

5. The container according to claim 4, wherein a bulge extending outwards is formed on each of the side walls provided with at least two support indentations in the region of each support indentation on the outer side of the corresponding side wall, and the at least two handles are each formed as a rib extending between the at least two bulges of a corresponding side wall transversely to the corresponding side wall.

6. The container according to claim 3, wherein:

lower sides of the at least four projections of the at least one support plate extend in a common plane, lower surfaces of the at least four support indentations extend in a common plane, and a distance between the common plane of the lower sides of the at least four projections of the at least one support plate and the lower side of the bottom is smaller than or equal to a distance between the common plane of the lower surfaces of the at least four support indentations and an upper border of the container.

7. The container according to claim 3, wherein:

at edge portions of the bottom, which extend along edge portions of the at least one support plate provided with at least two projections in each case, at least one column is formed which extends transversely downwards to the bottom, wherein the at least one column projects downwards from the container by less than the at least one support plate and projects outwards from the container by less than the at least four projections on the at least one support plate, and the edge portions of the side walls, facing away from the bottom, which are provided with at least two support indentations in each case and corresponding support indentations are coordinated with the projections on the support plate and the columns in such a way that, in a state in which the container is stacked on an identically constructed container, a lateral displacement of the container is prevented, a lateral displacement of the container in relation to the identically constructed container is limited and/or prevented by cooperation of the columns with an inner side of side walls of the identically constructed container, and the projections of the at least one support plate of the container do not touch inner surfaces of corresponding support indentations of the identically constructed container.

8. The container according to claim 1, wherein the ribs connecting the at least one support plate to the lower side of the bottom have apertures.

9. The container according to claim 8, wherein the apertures are not arranged mirror-symmetrically to each other.

10. The container according to claim 1, wherein the projections are coated with or made of a material which is softer than a material or materials of remaining parts of the container.

11. The container according to claim 1, wherein the bottom, the side walls, the at least one support plate and the ribs connecting the bottom and the at least one support plate are formed in one piece.

12. The container according to claim 1, wherein the container is made of plastic.

13. The container according to claim 1, wherein the at least one support plate has at least one aperture.

14. The container according to claim 1, wherein:

the bottom has a substantially rectangular outline, the side walls comprise two opposite, long side walls arranged at long edges of the bottom and two opposite, short side walls arranged at short edges of the bottom, and projections are formed only on edge portions of the at least one support plate extending along the long side walls.

15. A container, comprising:

a bottom;

side walls extending upwards from an upper side of the bottom; and at least one support plate spaced from a lower side of the bottom, which is connected to the lower side of the bottom via ribs extending transversely to the bottom and transversely to the at least one support plate, wherein:

at least two projections project laterally from at least one edge portion of the at least one support plate extending along at least one side wall of the side walls, at least two support indentations are formed in an upper edge portion of the at least one side wall for receiving at least two projections of a support plate of an identically constructed container stacked thereon, at least two laterally projecting projections are also formed on a second edge portion of the at least one support plate, wherein the second edge portion is opposite the at least one edge portion of the at least one support plate, a side wall that is opposite the at least one side wall also comprises at least two support indentations in the upper edge portion for receiving at least two laterally projecting projections of a support plate of an identically constructed container stacked thereon, at edge portions of the bottom, which extend along edge portions of the at least one support plate provided with at least two projections in each case, at least one column is formed which extends transversely downwards to the bottom, wherein the at least one column projects downwards from the container by less than the at least one support plate and projects outwards from the container by less than the at least four projections on the at least one support plate, and the edge portions of the side walls, facing away from the bottom, which are provided with at least two support indentations in each case and corresponding support indentations are coordinated with the projections on the support plate and the columns in such a way that, in a state in which the container is stacked on an identically constructed container, a lateral displacement of the container is prevented, a lateral displacement of the container in relation to the identically constructed container is limited and/or prevented by cooperation of the columns with an inner side of side walls of the identically constructed container, and the projections of the at least one support plate of the container do not touch inner surfaces of corresponding support indentations of the identically constructed container.

16. A container, comprising:

a bottom;

side walls extending upwards from an upper side of the bottom; and at least one support plate spaced from a lower side of the bottom, which is connected to the lower side of the bottom via ribs extending transversely to the bottom and transversely to the at least one support plate, wherein:

at least two projections project laterally from at least one edge portion of the at least one support plate extending along at least one side wall of the side walls, at least two support indentations are formed in an upper edge portion of the at least one side wall for receiving at least two projections of a support plate of an identically constructed container stacked thereon, and the projections are made of a material which is softer than a material or materials of remaining parts of the container.

* * * * *